US006871704B2

(12) United States Patent
Wilcox

(10) Patent No.: US 6,871,704 B2
(45) Date of Patent: Mar. 29, 2005

(54) WELL SHUT OFF DEVICE

(76) Inventor: James C. Wilcox, 7601 E. Island Rd., Pickford, MI (US) 49774

( * ) Notice: Subject to any disclaimer, the term of this patent is extended or adjusted under 35 U.S.C. 154(b) by 43 days.

(21) Appl. No.: 10/375,648

(22) Filed: Feb. 27, 2003

(65) Prior Publication Data

US 2003/0159822 A1 Aug. 28, 2003

Related U.S. Application Data

(60) Provisional application No. 60/360,752, filed on Feb. 28, 2002.

(51) Int. Cl.[7] ..... E21B 33/00

(52) U.S. Cl. ..... 166/106; 166/118

(58) Field of Search ..... 166/106, 179, 166/118, 123, 125, 126, 127, 133, 141, 143

(56) References Cited

U.S. PATENT DOCUMENTS

| | | | | | |
|---|---|---|---|---|---|
| 3,734,179 | A | * | 5/1973 | Smedley | 166/106 |
| 4,007,905 | A | * | 2/1977 | Mott | 251/1.1 |
| 4,545,433 | A | * | 10/1985 | Wambaugh | 166/105 |
| 4,655,284 | A | * | 4/1987 | McIlvride | 166/84.1 |
| 5,031,696 | A | * | 7/1991 | Zwiegel | 166/208 |
| 6,644,401 | B1 | * | 11/2003 | Miller | 166/75.14 |

* cited by examiner

*Primary Examiner*—Frank Tsay
(74) *Attorney, Agent, or Firm*—Irving M. Weiner; Pamela S. Burt; Weiner & Burt, P.C.

(57) ABSTRACT

A well shut off device for completely sealing off a flowing well. The resilient center seal member is sandwiched between upper and lower face plates. A group of fastening members holds together the face plates and the central seal member for urging the central seal member into intimate sealing contact with the well casing of the well and with the couplings when the fastening members are tightened.

16 Claims, 1 Drawing Sheet

WELL SHUT OFF DEVICE

The present patent application claims priority from and is based on U.S. Provisional Patent Application Ser. No. 60/360,752 filed Feb. 28, 2002.

The present invention relates generally to certain new and useful improvements in well shut off devices.

The present invention also provides a new and useful well shut off device. More particularly, the present invention relates to a novel water shut off device for sealing off a flowing well using a resilient sealing member.

More particularly, the present invention relates to a novel water shut off device for sealing off a flowing well using a resilient sealing member.

BACKGROUND OF THE INVENTION

Heretofore, various attempts have been made to effectively and efficiently seal wells. Such attempts have been relatively unsuccessful, and have been accompanied by various problems, including leakage through the attempted sealing member.

The relative art is exemplified by the following U.S. patents:

U.S. Pat. No. 5,165,473 issued in 1992 to Bode entitled "Positive Stop Collar";

U.S. Pat. No. 5,579,839 issued in 1996 to Culpepper entitled "Bulge Control Compression Packer".

It is a desideratum of the present invention to avoid the animadversions of the above described techniques and devices.

SUMMARY OF THE INVENTION

The present invention provides a new and useful well shut off device, comprising: an upper face plate having an upper coupling; a lower face plate having a lower coupling; said couplings being adapted to permit a shaft to pass therethrough; a center seal member disposed between said face plates; a plurality of bolts and nuts for holding together said face plates and said central seal member, and for urging said central seal member into intimate sealing contact with the well casing of the well and with said couplings when said nuts are tightened.

The present invention also provides a well shut off device for use with a well casing of a well comprising: an upper face plate having an upper coupling; a lower face plate having a lower coupling; a shaft passing through said upper coupling and said lower coupling; a center seal member disposed between said upper face plate and said lower face plate; and a plurality of adjustable fastening members for holding together said face plates and said central seal member, and for urging said central seal member into intimate sealing contact with said well casing of said well and with said couplings when said fastening members are tightened.

It is, therefore, one of the primary objects of the present invention to provide a novel and effective water flow shut off device.

It is another object of the present invention to provide a new and useful well shut off device as described hereinabove which completely seals off a flowing well.

It is a further object of the present invention to provide a new and useful well shut off device as described hereinabove wherein the central seal member may be fabricated from rubber, or any other suitable resilient substance.

The present invention possesses many other advantages and features which will become more apparent to those persons skilled in this particular area of technology and to others after having been exposed to the detailed description of one exemplary preferred embodiment of the present invention as set forth hereinbelow in conjunction with the accompanying drawings.

DETAILED DESCRIPTION OF ONE PREFERRED EMBODIMENT

Figure 1:
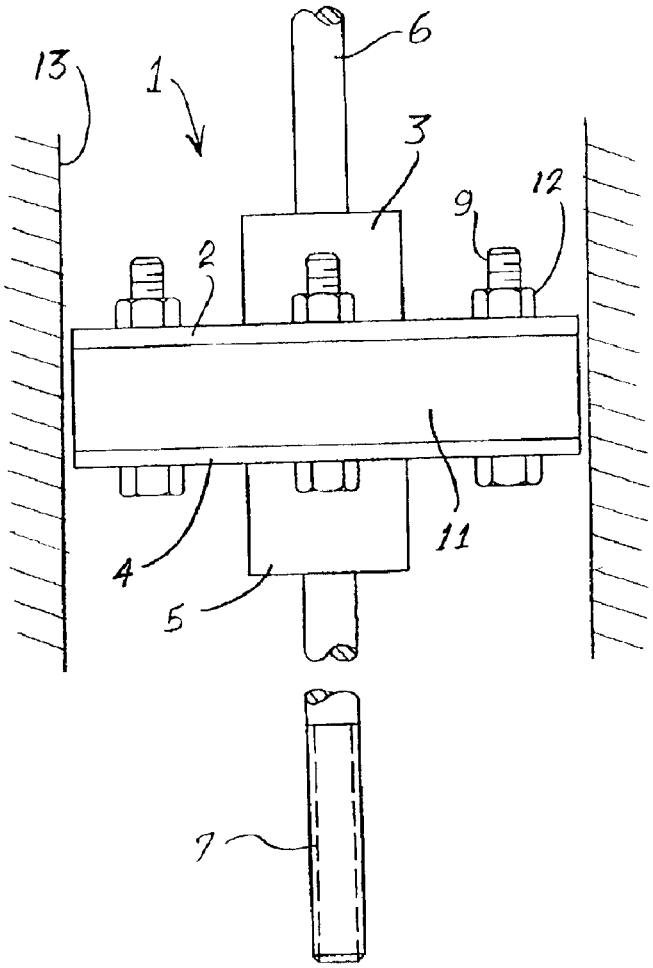
FIG. 1 is an elevational view of a preferred embodiment of the present invention disposed in a well casing.

In accordance with a preferred embodiment of the present invention, there is provided, as illustrated in FIG. 1, a new and useful well shut off device 1 for quickly and effectively sealing off a well.

The device 1 includes an upper face plate 2 having an upper coupling 3, and a lower face plate 4 having a lower coupling 5.

The couplings 3 and 5 are adapted to accommodate and permit a shaft 6 to pass therethrough. The lower portion 7 of the shaft 6 may extend downwardly to a pitless adapter (not shown).

The face plates 2 and 4 are provided with a plurality of equally spaced bolt holes 8 for accommodating a plurality of bolts 9 therein. For each bolt 9, there is provided an associated nut 12 for threaded engagement therewith.

Figure 2:
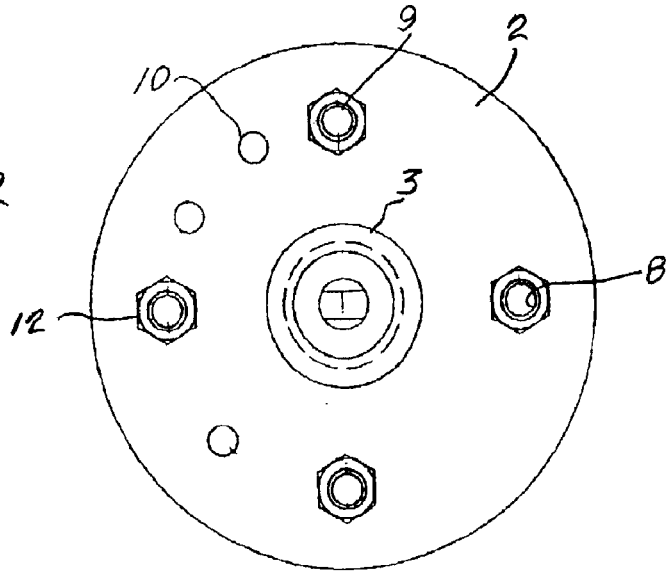
FIG. 2 illustrates a top plan view of the embodiment shown in FIG. 1.

As shown in FIG. 2, the plates 2 and 4 are also provided with apertures 10 for accommodating wires (not shown) which may extend therethrough downwardly to a pump (not shown) at the bottom of the well.

A central seal member 11 is sandwiched between the face plates 2 and 4. The central seal member 11 is preferably, but not necessarily, fabricated from rubber.

Upon tightening the nuts 12, the face plates 2 and 4 press in on the resilient central seal member 11 to tightly seal the couplings 3 and 5 and the wire apertures 10, and to urge the central seal member 11 into intimate sealing contact with the wall of the well casing 13.

There has been illustrated in the accompanying drawings and described hereinabove only one unique and novel preferred embodiment of the present invention which can be constructed in many different configurations, arrangements of components, sizes, and shapes.

It should be understood that many changes, modifications, variations and other uses and applications will become apparent to those persons skilled in this particular area of technology and to others after having been exposed to the present patent specification and accompanying drawings.

Any and all such changes, modifications, variations, and other uses and applications which do not depart from the spirit and scope of the present invention are therefore covered by and embraced within the present invention and patent application.

What is claimed is:

1. A well shut off device for use with a well casing of a well, comprising:

an upper face plate having a centrally-located upper coupling;

a lower face plate having a centrally-located lower coupling;

a shaft passing through said centrally-located upper coupling and said centrally-located lower coupling;

said upper face place and said lower face place are provided with a plurality of electrical wire apertures for accommodating electrical wires to pass therethrough;

a center seal member disposed between said upper face plate and said lower face plate; and a plurality of adjustable fastening members for holding together said face plates and said central seal member for pressing in on said central seal member to tightly and quickly completely seal said centrally-located upper and lower couplings and said electrical wire apertures, and for urging said central seal member into intimate quick and complete sealing contact with said well casing of said well and with said centrally-located upper and lower couplings when said fastening members are tightened.

2. A well shut off device according to claim 1, wherein:

said plurality of adjustable fastening devices comprises a plurality of bolts and nuts for holding together said face plates and said central seal member, and for urging said central seal member into intimate contact with said well casing of said well and with said couplings when said nuts are tightened.

3. A well shut off device according to claim 2, wherein:

said central seal member is fabricated from a resilient substance.

4. A well shut off device according to claim 3, wherein:

said central seal member is fabricated from rubber.

5. A well shut off device according to claim 4, wherein:

said upper face plate and said lower face plate are provided with a plurality of equally spaced apertures for accommodating said plurality of adjustable fastening means.

6. A well shut off device according to claim 3, wherein:

said upper face plate and said lower face plate are provided with a plurality of equally spaced apertures for accommodating said plurality of adjustable fastening means.

7. A well shut off device according to claim 2, wherein:

said central seal member is fabricated from rubber.

8. A well shut off device according to claim 7, wherein:

said upper face plate and said lower face plate are provided with a plurality of equally spaced apertures for accommodating said plurality of adjustable fastening means.

9. A well shut off device according to claim 2, wherein:

said upper face plate and said lower face plate are provided with a plurality of equally spaced apertures for accommodating said plurality of adjustable fastening means.

10. A well shut off device according to claim 1, wherein:

said central seal member is fabricated from a resilient substance.

11. A well shut off device according to claim 10, wherein:

said central seal member is fabricated from rubber.

12. A well shut off device according to claim 11, wherein:

said upper face plate and said lower face plate are provided with a plurality of equally spaced apertures for accommodating said plurality of adjustable fastening means.

13. A well shut off device according to claim 10, wherein:

said upper face plate and said lower face plate are provided with a plurality of equally spaced apertures for accommodating said plurality of adjustable fastening means.

14. A well shut off device according to claim 1, wherein:

said central seal member is fabricated from rubber.

15. A well shut off device according to claim 14, wherein:

said upper face plate and said lower face plate are provided with a plurality of equally spaced apertures for accommodating said plurality of adjustable fastening means.

16. A well shut off device according to claim 1, wherein:

said upper face plate and said lower face plate are provided with a plurality of equally spaced apertures for accommodating said plurality of adjustable fastening means.

* * * * *